US009745775B2

(12) United States Patent
Weinraub

(10) Patent No.: US 9,745,775 B2
(45) Date of Patent: Aug. 29, 2017

(54) DOOR LATCH PROTECTOR SYSTEM AND SPACER

(76) Inventor: Adam S. Weinraub, Orange, CA (US)

( * ) Notice: Subject to any disclaimer, the term of this patent is extended or adjusted under 35 U.S.C. 154(b) by 2263 days.

(21) Appl. No.: 12/606,416

(22) Filed: Oct. 27, 2009

(65) Prior Publication Data

US 2011/0095548 A1 Apr. 28, 2011

(51) Int. Cl.
*E05B 17/00* (2006.01)
*E05B 17/20* (2006.01)
*E05C 21/00* (2006.01)

(52) U.S. Cl.
CPC ..... *E05B 17/2003* (2013.01); *Y10T 292/79* (2015.04)

(58) Field of Classification Search
USPC ..... 292/346, 1, DIG. 54, DIG. 53
See application file for complete search history.

(56) References Cited

U.S. PATENT DOCUMENTS

| | | | | |
|---|---|---|---|---|
| 2,489,072 | A | 11/1949 | Ausubel | |
| 3,290,081 | A | 12/1966 | Sushan | |
| 3,405,962 | A | 10/1968 | Sushan | |
| D229,665 | S | 12/1973 | Wilmot | |
| 3,796,071 | A | 3/1974 | Crepinsek | |
| 4,130,311 | A | 12/1978 | Sushan | |
| 4,484,463 | A | 11/1984 | Hennessy | |
| 4,547,009 | A | 10/1985 | Allen | |
| 4,725,084 | A | 2/1988 | Catricola | |
| 4,751,834 | A | 6/1988 | Beck | |
| 4,861,082 | A * | 8/1989 | Priola et al. | 292/346 |
| 4,885,921 | A | 12/1989 | Sharav | |
| 5,131,189 | A | 7/1992 | Mascotte | |
| 5,269,100 | A | 12/1993 | Fontenot | |
| 5,415,020 | A * | 5/1995 | Allenbaugh | 70/417 |
| 5,603,194 | A * | 2/1997 | Fridlyand et al. | 52/515 |
| 6,406,076 | B1 * | 6/2002 | Zarzycki, Jr. | 292/346 |
| 8,028,376 | B2 * | 10/2011 | Karapetyan | 16/82 |
| 2002/0163218 | A1 * | 11/2002 | Stubbings et al. | 296/37.7 |
| 2003/0062731 | A1 * | 4/2003 | Richmond et al. | 292/346 |

OTHER PUBLICATIONS

Don-Jo Mfg. Co., Inc. Catalog/Data Sheet pp. 39-43, Latch Protectors, Copyright 2003.

Don-Jo Mfg. Co, Inc., Data Sheet for Latch Protectors, (LP-107, LP-207 Series; SLP-106, SLP-206, Short Type; LP-307 Series).

MAG Security Latch Guard Installation Instructions, 8849-AL, Copyright 2001, M.A.G. Eng. & Mfg. Inc. (1 page).

* cited by examiner

*Primary Examiner* — Carlos Lugo
(74) *Attorney, Agent, or Firm* — Larry K. Roberts

(57) ABSTRACT

A door latch protector system for protecting a latch of a door. An exemplary embodiment includes a latch protector plate including a door overlapping portion and a frame overlapping portion, the door overlapping portion having a first planar surface configured to contact the exterior door surface in an installed configuration. At least one spacer plate is configured to be positioned between the door overlapping portion and a surface of the door. The spacer plate includes opposed first and second planar spacer surfaces, the first planar surface configured to contact the first planar surface of the latch protector plate in the installed configuration. The spacer plate has an external peripheral profile matching a corresponding external profile of the door overlapping portion of the latch protector plate to eliminate gaps between the corresponding external profile of the door overlapping portion which would allow the introduction of burglary tools.

14 Claims, 3 Drawing Sheets

FIG. 3
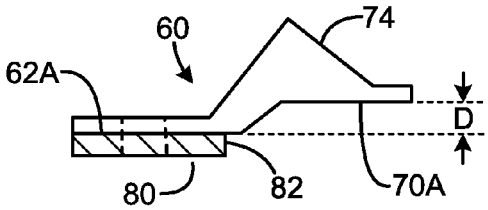
FIG. 2
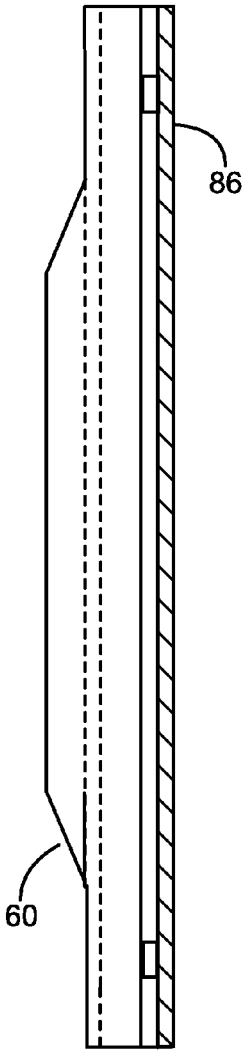
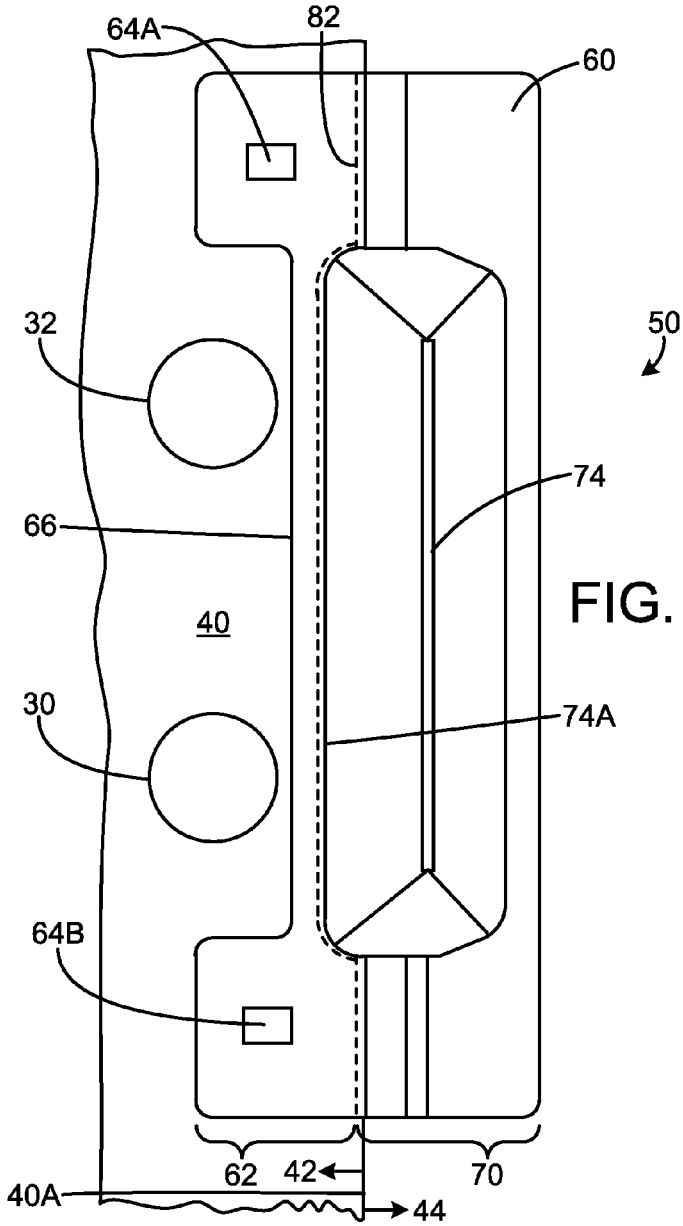
FIG. 1

DOOR LATCH PROTECTOR SYSTEM AND SPACER

BACKGROUND

Latch protectors are in use which protects the latches of doors from tampering. For some door installations, there can be a disparity between the plane of the door and the plane of the adjacent door frame. This can lead to problems in installation of the latch protector.

BRIEF DESCRIPTION OF THE DRAWINGS

Features and advantages of the disclosure will readily be appreciated by persons skilled in the art from the following detailed description when read in conjunction with the drawing wherein:

FIG. 1 is a top plan view of an exemplary embodiment of a door latch protection system.

FIG. 2 is a side view of the exemplary embodiment of the door latch protection system of FIG. 1.

FIG. 3 is an end view of the exemplary embodiment of the door latch protection system of FIG. 1.

DETAILED DESCRIPTION

Figure 4B:
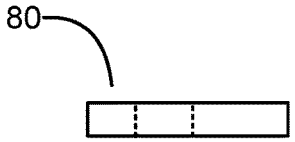
FIGS. 4A and 4B are respective top and end views of an exemplary embodiment of a latch spacer for a latch protector system.
Figure 4A:
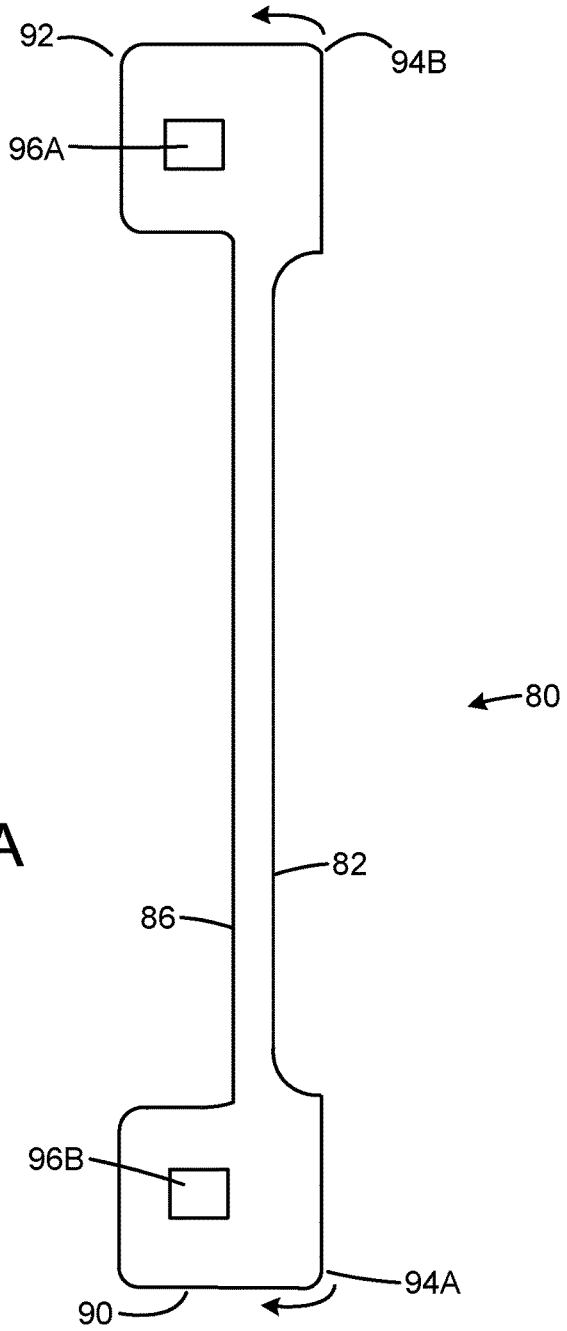

In the following detailed description and in the several figures of the drawing, like elements are identified with like reference numerals. The figures may not be to scale, and relative feature sizes may be exaggerated for illustrative purposes.

An exemplary embodiment of a door latch protector system allows for adjustment of a latch protector plate in a direction transverse to the plane of the door. This is very important in some applications. There is commonly an offset of approximately ¼" between the first plane of the latch protector that screws flat against the door and the second plane that overlaps the frame. There are occasions in which, depending on the distance relationship between the door and the frame, a ¼" offset is not enough and the latch protector will act as a stop not allowing the door to close fully.

It may not be desirable to increase the offset more than ¼" between the first plane and the second plane of the protector plate, because there will be too large of a gap between the latch protector and the frame when the extra clearance is not needed. Too large a gap may allow easier introduction to prying devices such as screwdrivers, hammer claws, or similar devices.

If faced with a door that the latch protector hits or rubs on the frame, there are few options:

01) Do not install a latch protector leaving the door vulnerable.

02) Attempt to bend or file the latch protector enough to clear the frame which is difficult at best.

In an exemplary embodiment, a spacer or shim is provided in combination with a latch protector plate, in which the spacer or shim has substantially the same size and/or shape as the latch protector plate portion associated with the first plane. The spacer or shim allows the latch protector plate and spacer to lay flat and secure with no gaps to allow the introduction of burglary tools. In an exemplary embodiment, the spacer does not extend beyond the edge of the door to cause interference with the strike and/or latch plates of the locks or the frame.

The thickness of the spacers may be varied but will typically be approximately ⅛". Multiple spacers with the same or various thicknesses can be used depending on the application.

An exemplary embodiment of a door latch protector system 50 is illustrated in FIGS. 1A-4B. The system includes a latch protector plate 60, and a spacer plate 80. The latch protector plate 60 includes a door overlapping portion 62 and a frame overlapping portion 70. Latch protector plates having the general configuration illustrated in FIG. 1 are available in the marketplace. The plate 60 may be installed on the outward side of an outwardly swinging door, so that the plate overlaps the edge of a door 40, whose edge location is generally indicated by line 40A in FIG. 1.

The plate 60 includes openings 64A and 64B to accept mounting hardware such as bolts which pass into the door to securely mount the plate to the door. The plate 60 may have an inward edge 66 defining an inner relieved area 66A, which allows positioning of the plate near, and prevents interference with, locksets such as locksets 30, 32 installed in the door.

The door overlapping portion 62 of the plate 60 has a first planar surface 62A configured to contact the exterior door surface when installed on the door. The frame overlapping portion 70 of the plate 60 has a second planar surface 70A. The first and second planar surfaces are generally parallel, but offset by a distance "D" which, as noted above, is typically on the order of ¼ inch. The frame overlapping portion 70 in this exemplary embodiment defines a V-shaped recess 74 which provides clearance for strike plates which may protrude above the plane of the door while still covering the strike plate and the lock hardware under the plate to resist use of burglary tools.

As noted, the offset distance D between the first and second planar surfaces may in some door installation cases not be sufficient, and the second surface may come into contact with the door jamb to prevent closure of the door. A spacer 80 is provided to address this problem. An exemplary embodiment of the spacer 80 has substantially the same size and/or shape and/or edge profile as the first planar surface 62A associated with latch protector plate portion 62 of the latch protector plate 60. Thus, for the exemplary plate 60, the spacer 80 is a plate having a peripheral shape or configuration which matches that of the plate 60, including an inward surface edge 86 which generally matches the inward surface 66, as well as an outward surface 82 which matches the edge profile 74A of the inward side of the V-shaped region 74. The end profiles of the spacer ends 90, 92 also match the end profiles of the ends of the latch protector plate 60. Thus, the edge profile of the spacer plate 80 at least in the inward region between points 94A and 94B (indicated by the arrows in FIG. 4A) matches the profile of the plate 60 in the same regions. In this exemplary embodiment, the entire peripheral edge profile of the spacer 80 matches the entire peripheral edge profile of the first planar surface portion 62A of the plate 60, including the region underlying the portion of the plate 60 extending over the door latch. With the spacer profile matching that of the first planar surface 62A of plate portion 62, the plate portion 62 is fully supported in an elevated position above the door surface. In other embodiments, the peripheral edge profile of the spacer 80 may only substantially match the peripheral edge profile of the first planar surface portion 62A, with some deviation from the edge profile of surface portion 62A. For example, the spacer

80 may be oversized relative to the first planar surface 62A, such that an edge region of the spacer extends outside of the periphereal edge of the surface 62A inside the door edge; in this embodiment, the edge region may provide a bezel region while still protecting against tampering efforts.

In an exemplary embodiment, the spacer plate 80 has fastener openings 94A, 94B which are positioned to match the openings 64A, 64B of the latch protector plate 60, to allow the fasteners used to secure the plate 60 to the door to pass through the spacer plate and sandwich the spacer plate between the door surface and the latch protector plate.

The spacer may have a thickness in one embodiment of ⅛ inch, although spacers of other thicknesses may be used as well. The spacers are typically fabricated of metal such as steel, and may be fabricated of the same material as the latch protector plate.

With the spacer 80 installed between the latch protector plate 60 and the door surface, the frame overlapping portion 70 of the plate will have an additional clearance, defined by the thickness of the spacer, to accommodate a door jamb which is offset from the plane of the door by a distance which is greater than that which can be accommodated by the plate 60 and its offset distance D.

Figure 5B:
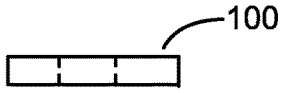
FIGS. 5A and 5B are respective top and end views of another embodiment of a latch spacer for a latch protector system.
Figure 5A:
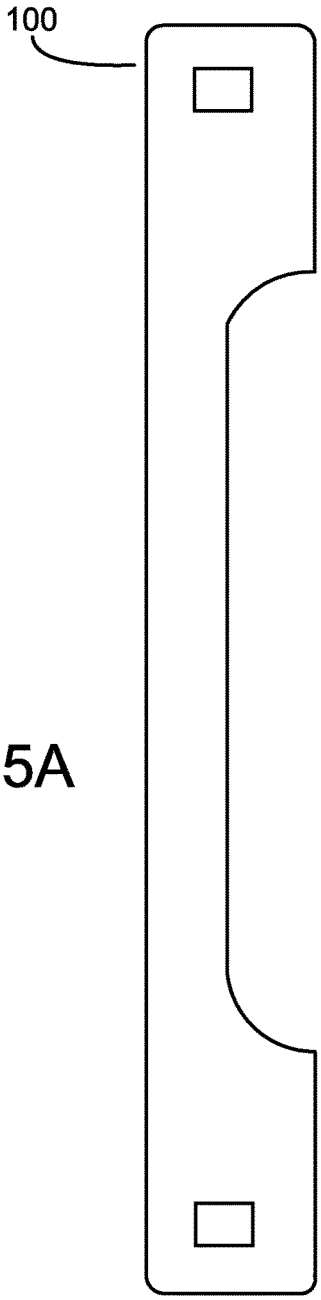

Other embodiments of the latch protector plate and the spacer plate may be employed. FIG. 5 illustrates an alternate embodiment of a spacer plate 100, similar to spacer 80, but without the inward relieved region to accommodate the locksets. The corresponding latch plate is not shown in FIG. 5, but the door overlaying surface would have a corresponding edge profile matching the spacer profile.

Other embodiments of the latch protector plate and the spacer plate may have utility for situations in which the protector plate has no offset between the two planes, i.e. in the case in which the dimension D is zero or near zero.

Although the foregoing has been a description and illustration of specific embodiments of the invention, various modifications and changes thereto can be made by persons skilled in the art without departing from the scope and spirit of the subject matter.

What is claimed is:

1. A door latch protector system for protecting a latch of an outswinging door mounted in a door frame and allowing adjustment of a latch protector plate in a direction transverse to the plane of the door, comprising:

a latch protector plate including a door overlapping portion and a frame overlapping portion, the door overlapping portion having a first planar surface configured to contact the exterior door surface in an installed configuration, the frame overlapping portion configured to overlap a portion of the door frame;

at least one spacer plate configured to be positioned between the door overlapping portion and the exterior door surface of the door to allow adjustment of a position of the latch protector plate relative to the plane of the door and thereby spacing the frame overlapping portion away from the door frame by a spacer distance equal to a thickness of the at least one spacer plate, the at least one spacer plate including opposed first and second planar spacer surfaces, the first planar surface configured to contact the first planar surface of the latch protector plate in the installed configuration, the second planar surface configured to contact the exterior door surface, and wherein the at least one spacer plate has an external peripheral profile matching a corresponding external profile of the door overlapping portion of the latch protector plate to eliminate gaps between said corresponding external profile of the door overlapping portion allowing the introduction of burglary tools.

2. The system of claim 1, wherein the at least one spacer plate is configured such that an edge of the spacer plate does not extend beyond an adjacent edge of the door to prevent interference with a strike and/or latch plate of a lock or the door frame.

3. The system of claim 1, wherein the spacer plate has a thickness of ⅛ inch.

4. The system of claim 1, wherein the frame overlapping portion includes a second planar surface which is parallel to but offset from the first planar surface by an offset distance, and wherein said spacer plate has a thickness dimension which positions the second planar surface of the latch protector plate away from a frame structure of the door so that the second surface of the frame overlapping portion does not interfere with closure of the door.

5. The system of claim 1, wherein the door overlapping portion of the latch protector plate has an inward edge defining an inner relieved area to allow positioning of the latch protector plate near a lockset, and said spacer plate has a corresponding inward edge matching the profile of said inner relieved area of the latch protector plate.

6. The system of claim 1, wherein the latch protector plate and the spacer plate are fabricated of steel.

7. The system of claim 1, wherein the door overlapping portion of the latch protector plate includes a plurality of fastener openings arranged in a fastener pattern to accept a plurality of fasteners to secure the latch protector plate to the door, and the spacer plate has a corresponding plurality of spacer plate openings arranged in a spacer plate opening pattern matching the fastener patter to allow the plurality of fasteners to pass through and into the door.

8. The system of claim 7, wherein the spacer plate has a thickness of ⅛ inch.

9. The system of claim 7, wherein the frame overlapping portion includes a second planar surface which is parallel to but offset from the first planar surface by an offset distance, and wherein said spacer plate has a thickness dimension which positions the second planar surface of the latch protector plate away from a frame structure of the door so that the second surface of the frame overlapping portion does not interfere with closure of the door.

10. The system of claim 7, wherein the door overlapping portion of the latch protector plate has an inward edge defining an inner relieved area to allow positioning of the latch protector plate near a lockset, and said spacer plate has a corresponding inward edge matching the profile of said inner relieved area of the latch protector plate.

11. The system of claim 7, wherein the latch protector plate and the spacer plate are fabricated of steel.

12. The system of claim 7, wherein the door overlapping portion of the latch protector plate includes a plurality of fastener openings arranged in a fastener pattern to accept a plurality of fasteners to secure the latch protector plate to the door, and the spacer plate has a corresponding plurality of spacer plate openings arranged in a spacer plate opening pattern matching the fastener patter to allow the plurality of fasteners to pass through and into the door.

13. A door latch protector system for protecting a latch of an outswinging door mounted in a door frame, comprising:

a latch protector plate including a door overlapping portion and a frame overlapping portion, the door overlapping portion having a first planar surface configured to contact the exterior door surface in an installed configuration;

at least one spacer plate configured to be positioned between the door overlapping portion and the exterior door surface of the door to space a position of the latch protector plate from the exterior door surface of the door, the at least one spacer plate including opposed first and second planar spacer surfaces, the first planar surface configured to contact the first planar surface of the latch protector plate in another installed configuration to space the frame overlapping portion of the latch protector plate from the door frame so that the frame overlapping portion does not interfere with closure of the door, the second planar surface of the spacer plate configured to contact the exterior door surface, and wherein the at least one spacer plate has an external peripheral profile substantially matching a corresponding external profile of the door overlapping portion of the latch protector plate.

14. The system of claim 13, wherein the at least one spacer plate is configured such that an edge of the spacer plate does not extend beyond an adjacent edge of the door to prevent interference with a strike and/or latch plate of a lock or the door frame.

* * * * *